US006953883B1

(12) United States Patent
Jacobson

(10) Patent No.: US 6,953,883 B1
(45) Date of Patent: Oct. 11, 2005

(54) DRUM HOOP

(76) Inventor: Lucas A. Jacobson, 5708 Pennsylvania Ave. N., Crystal, MN (US) 55428

( * ) Notice: Subject to any disclaimer, the term of this patent is extended or adjusted under 35 U.S.C. 154(b) by 84 days.

(21) Appl. No.: 10/668,540

(22) Filed: Sep. 23, 2003

(51) Int. Cl.[7] ..... G10D 13/02
(52) U.S. Cl. ..... 84/411 R; 84/413; 84/411 A
(58) Field of Search ..... 84/413, 411 A, 84/411 R

(56) References Cited

U.S. PATENT DOCUMENTS 4,062,265 A * 12/1977 Walker ..... 84/312 R
4,188,852 A * 2/1980 Light ..... 84/411 A
4,218,952 A * 8/1980 Arbiter ..... 84/411 A
5,561,255 A * 10/1996 Sassmannshausen et al. . 84/413

* cited by examiner

*Primary Examiner*—Shih-Yung Hsieh

(57) ABSTRACT

A drum hoop includes an annular ring having inward and outward faces and a plurality of flanges formed on the outward face projecting radially outwardly from the lower edge. A plurality of parallel visual guidelines are formed on the inward face of the ring positioned parallel to a reference plane formed by the lower surfaces of the flanges.

11 Claims, 2 Drawing Sheets

DRUM HOOP

CROSS-REFERENCES TO RELATED APPLICATIONS (Not applicable)

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to a drums, and more particularly to an improved hoop for retaining the drum head on a drum.

(2) Background Information

Drums typically are constructed of a layer of membrane stretched over a frame and pulled taut. The membrane, or drumhead resonates to produce a sound upon being struck with a drumstick or other object. Originally, animal skin or hide was used for the membrane, while currently synthetics and other man-made materials have become the preferred material for the drumhead.

The drum hoop is a ring that holds the drumhead stretched tightly over one end of a generally cylindrical shell. The hoop may be adjusted relative to the shell to tighten or loosen the drumhead by the adjustment of a plurality of bolts arranged around the circumference of the shell and hoop and interconnecting the two. The bolts are then turned to draw the hoop down over the rim of the drum shell towards receivers on the shell through which the bolts are threaded, tensioning the membrane. The drumhead is thereby tuned to the desired pitch by the rotation of the plurality of bolts so that the hoop is at a constant distance from the lugs.

One of the drawbacks of current drums is the difficulty in determining whether the hoop is uniformly tightened around the entire circumference of the shell. This would occur either upon initial tuning, or during use, if the drummer intentionally changed the tune of the drum during a performance.

BRIEF SUMMARY OF THE INVENTION

It is therefore a general object of the present invention to provide an improved hoop for retaining a drumhead on a shell.

A further object is to provide and improved drum hoop that permits the drummer to tune a drum more uniformly and easily.

These and other objects will be apparent to those of ordinary skill in the art.

The drum hoop of the present invention includes an annular ring having inward and outward faces and a plurality of flanges formed on the outward face projecting radially outwardly from the lower edge. A plurality of parallel visual guidelines are formed on the inward face of the ring positioned parallel to a reference plane formed by the lower surfaces of the flanges.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
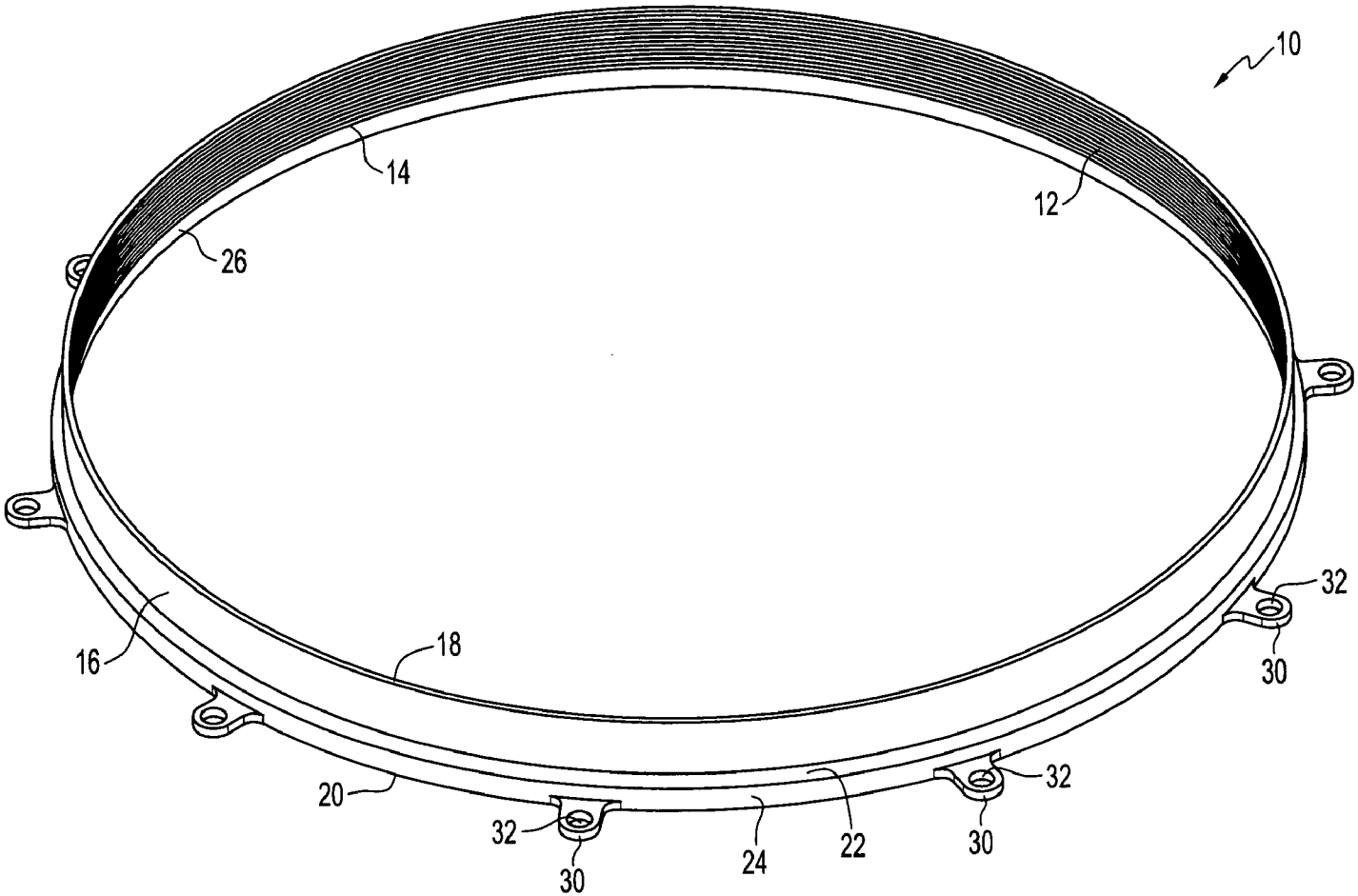
FIG. 1 is a perspective view of a drum hoop of the present invention.

Referring now to the drawings, in which similar or corresponding parts are identified with the same reference numeral, and more particularly to FIG. 1, the drum hoop of the present invention is designated generally at 10, and is formed from an annular ring 12 having an inward face 14, an outward face 16, an upper edge 18 and a lower edge 20.

The ring 12 is preferably formed of metal, but may be fabricated of wood or of a man-made material as well. An outwardly projecting annular lip 22 is formed near the lower edge 20 of ring 12, and has a depending annular leg 24 extending to the ring lower edge 20. This forms an annular notch 26 on the lower inward face of ring 12 for receiving and attaching the peripheral edge 28*a* of a drumhead membrane 28 (shown in FIG. 2) in any conventional fashion.

A plurality of flanges 30 project radially outwardly from the lower edge of the outward face 16 of ring 12. Flanges 30 are spaced uniformly around the circumference of ring 12 and each has an aperture 32 extending vertically therethrough.

Figure 2:
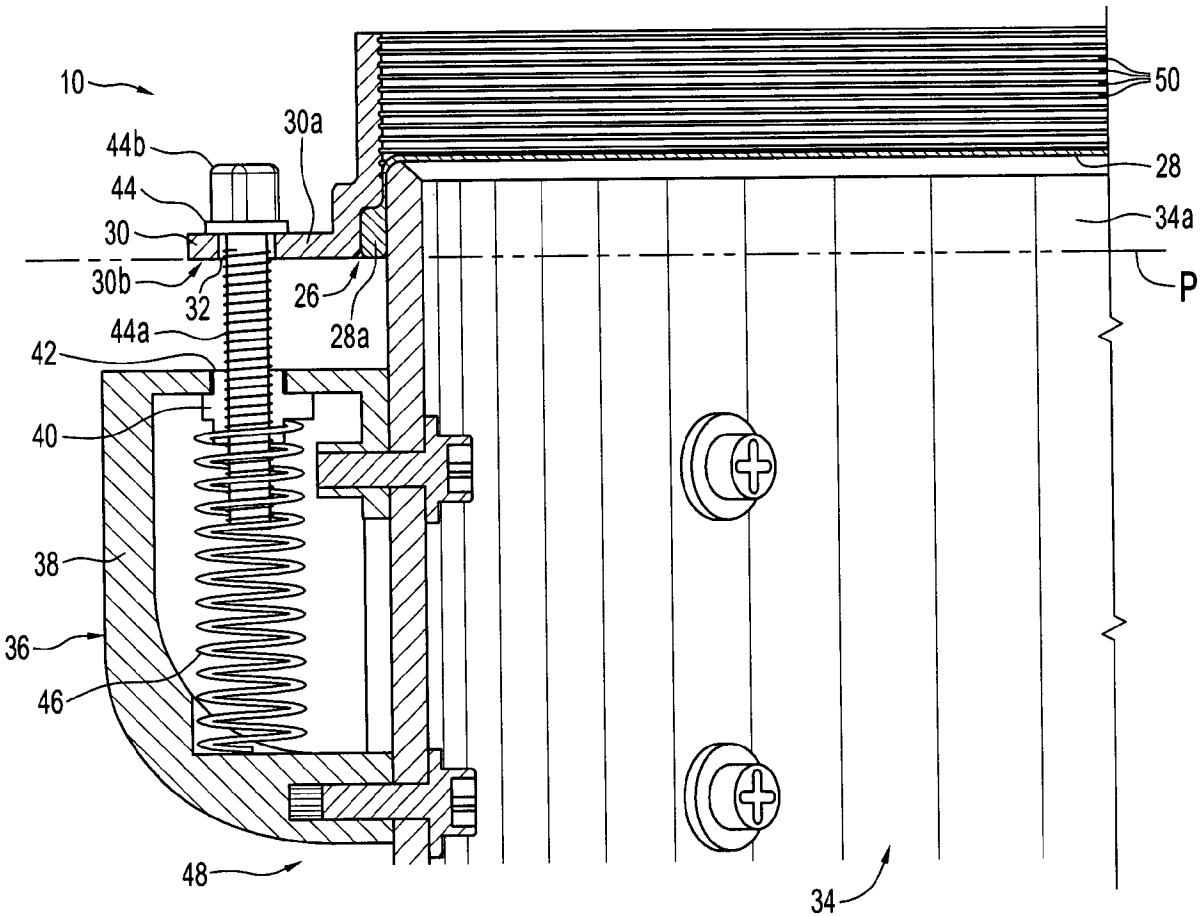
FIG. 2 is a cross-sectional view taken at lines 2—2 in FIG. 1, with a shell and connecting bolts added for clarity.

Referring now to FIG. 2, hoop 10 is shown with a drumhead 28 attached around its peripheral edge 28*a* within notch 26. Drumhead 28 is positioned over the open cylindrical end 34*a* of a drum shell 34 with the hoop radially outwardly of the shell 34.

A plurality of receivers 36 are mounted on the outward face of shell 34 and spaced uniformly around the shell so as to coincide with the flanges 30 on the hoop 10. Each receiver 36 includes a hollow housing 38 with an interiorly threaded nut 40 journaled within an aperture 42 in the upper end of the housing 38. Nut 40 selectively receives the threaded end 44*a* of an adjustment bolt 44. Nut 40 is biased upwardly into position within housing aperture 42 by a coil spring 46 within receiver housing 38.

Each nut 40 has a threaded aperture therein which will align coaxially with the flange apertures 32 when the hoop 10 is placed on the shell 34. Bolts 44 extend through the flange apertures 32 and threadably engage the threaded apertures of nuts 40 in the receivers 36. Bolts 44 have an enlarged head 44*b* that will engage the upper surfaces 30*a* of flanges 30 to draw the flanges 30 and thereby the hoop 10 downwardly towards the receivers 36 when the bolts 44 are rotated in the nuts 40. This, in turn, will stretch the drumhead 28 and "tune" the drum (designated generally at 48).

The bottom surfaces 30*b* of flanges 30 reside within a plane "P", which serves as a reference plane. The objective of the user is to rotate each bolt 44 so as to uniformly draw down each of the flanges 30, so that the drumhead 28 is uniformly stretched around the circumference of the shell upper edge 34*a*. However, as noted above, this is difficult to do without actually measuring the distance between the drumhead 28 and the reference plane P around the entire perimeter of shell upper end 34*a*.

The inventor has overcome this problem by modifying the hoop 10 to provide a series of parallel grooves 50 on the inward face 14 of ring 12. Grooves 50 are uniformly spaced apart and are parallel to the reference plane P of hoop 10. In this way the user can visually determine the extent to which each bolt 44 is drawn down toward the associated receiver 36, by viewing the nearest groove 50 revealed above the surface of drumhead 28. If the groove 50 is parallel to the drumhead, then the user knows that the drumhead is uniformly tightened in position. If the drumhead is not uniformly tightened, then a groove 50 will be sloped relative to the drumhead, which is easily perceived by the user.

It should be noted that the grooves 50 are aligned parallel to the reference plane P rather than the upper edge 18 of ring 12, since the upper edge need not necessarily be parallel to the reference plane P, and does not affect the tuning of the drum 48.

While grooves 50 are disclosed in the preferred embodiment of the invention, grooves 50 could be replaced with printed indicia on the inward surface 14 of ring 12 if desired. Similarly, the grooves 50 could be embossed, or could be projections rather than grooves cut into the ring 12. Grooves 50 thereby form visual guidelines parallel to the reference plane P for the tuning of a drum 48. In addition, grooves 50, or equivalent printed indicia, are not required to be continuous around 12. Rather, they are only required to be located diametric each flange 30 and the associated receiver 36. Thus, guidelines 50 could actually be a series of aligned marks or short grooves around the interior surface of ring 12.

Preferably, the visual guidelines 50 are spaced sufficiently close that the uniform tautness of the drumhead may be accurately reflected, yet far enough apart that the lines do not "blur" together when viewed. To prevent such "blurring", color-coding of the visual guidelines is possible, making is possible to provide more lines spaced closer together than would be preferred if the guidelines were of a single color.

Whereas the invention has been shown and described in connection with the preferred embodiments thereof, many modifications, substitutions and additions may be made which are within the intended broad scope of the appended claims.

What is claimed is:

1. A drum hoop, comprising:

an annular ring having an inward face, an outward face, and upper edge, and a lower edge;

a plurality of flanges formed on the outward face of the ring, projecting radially outwardly from the lower edge thereof, said flanges having a lower surface residing within a single reference plane; and a plurality of parallel visual guidelines formed on the inward face of the ring, said guidelines positioned parallel to the reference plane.

2. The drum hoop of claim 1, wherein said guidelines are uniformly spaced apart.

3. The drum hoop of claim 1, wherein said guidelines are printed indicia.

4. The drum hoop of claim 3, wherein each said guideline is formed of a continuous line of printed indicia extending around the inward face of the ring.

5. The drum hoop of claim 1, wherein said guidelines are grooves formed into the surface of the ring.

6. The drum hoop of claim 5, wherein each said guideline is a continuous groove extending around the inward face of the ring.

7. A drum hoop for retaining a drumhead on a drum shell, comprising:

an annular ring having an inward face, an outward face, and upper edge, and a lower edge;

a plurality of flanges formed on the outward face of the ring, projecting radially outwardly from the lower edge thereof, said flanges having a lower surface residing within a single reference plane; and a plurality of parallel visual guidelines formed on the inward face of the ring, said guidelines positioned parallel to the reference plane.

8. The drum hoop of claim 7, wherein said guidelines are uniformly spaced apart.

9. The drum hoop of claim 7, wherein said guidelines are printed indicia.

10. The drum hoop of claim 7, wherein said guidelines are grooves formed into the surface of the ring.

11. A method for evenly tuning a drumhead on a drum, the drum of a type having a shell with an open end and a drum hoop adjustably connected to the shell to stretch a drum head over the open end of the shell, the drum hoop including a plurality of flanges formed on the outward face of the ring, projecting radially outwardly from the lower edge thereof, said flanges having a lower surface residing within a single reference plane, the drum hoop of the type having a plurality of parallel visual guidelines on an inward face oriented parallel to the reference plane, comprising the step of adjusting the connection of the hoop to the shell until the drumhead is parallel to the drumhead is taut and one of the visual guidelines.

* * * * *